US005359408A

United States Patent [19]

Inada et al.

[11] Patent Number: 5,359,408

[45] Date of Patent: Oct. 25, 1994

[54] PACKAGE INSPECTION APPARATUS

[75] Inventors: Kenichi Inada, Ohtsu; Tetsuji Masai, Kusatsu; Yutaka Okimura, Takatsuki, all of Japan

[73] Assignee: Murata Kikai Kabushiki Kaisha, Kyoto, Japan

[21] Appl. No.: 888,045

[22] Filed: May 21, 1992

[30] Foreign Application Priority Data

May 23, 1991 [JP] Japan ..... 3-046925[U]
Jul. 1, 1991 [JP] Japan ..... 3-050620[U]

[51] Int. Cl.[5] ..... G01N 21/88

[52] U.S. Cl. ..... 356/238; 250/461.1; 250/223 R

[58] Field of Search ..... 356/237, 238; 250/223 R, 461.1; 358/106, 101

[56] References Cited

U.S. PATENT DOCUMENTS

| | | | |
|---|---|---|---|
| 4,184,769 | 1/1980 | Aeppli | 356/430 |
| 4,184,770 | 1/1980 | Pinior | 356/430 |
| 4,767,212 | 8/1988 | Kitahashi et al. | 358/106 |
| 4,866,289 | 9/1989 | Kawamura et al. | 356/238 |
| 4,877,967 | 10/1989 | Kawamura | 250/461.1 |
| 4,988,204 | 1/1991 | Sakaguchi et al. | 356/237 |
| 5,138,151 | 8/1992 | Inada et al. | 250/223 R |

*Primary Examiner*—Robert J. Warden
*Assistant Examiner*—Hien Tran
*Attorney, Agent, or Firm*—Spensley Horn Jubas & Lubitz

[57] ABSTRACT

A package inspection apparatus comprising a tray having a peg inclined for mounting a package thereon, a conveyor having a pair of chains for carrying the tray, an inspection box mounted on the conveyor, a light source and a camera mounted in the inspection box for inspecting for bunch winding and bulge winding of the package, and a package weight measuring instrument vertically movably mounted between the chains.

5 Claims, 8 Drawing Sheets

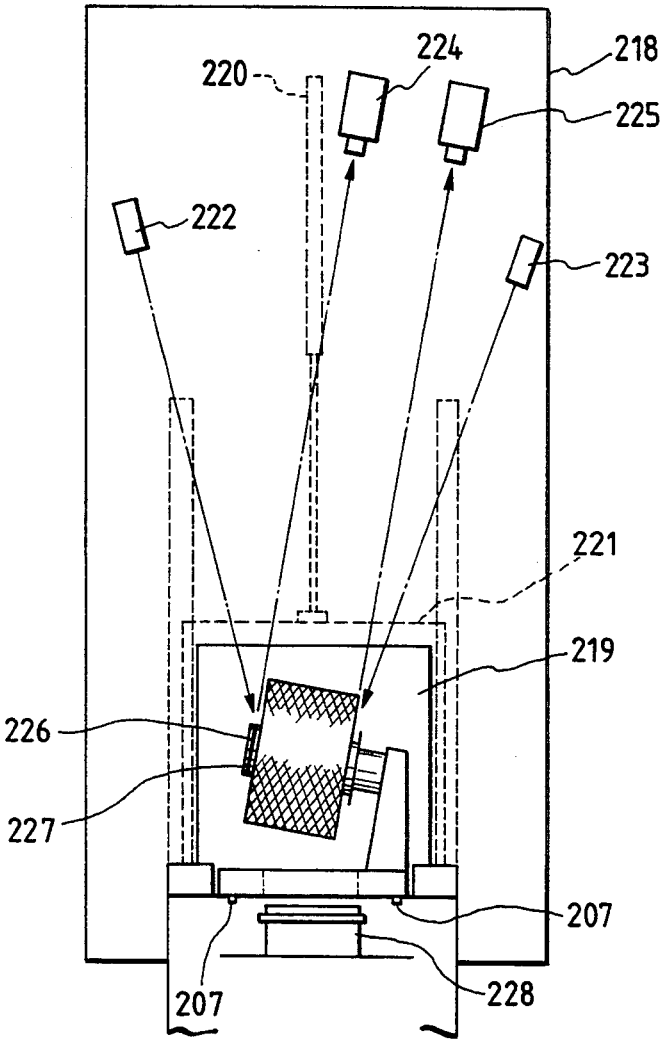
FIG. 10
FIG. 11
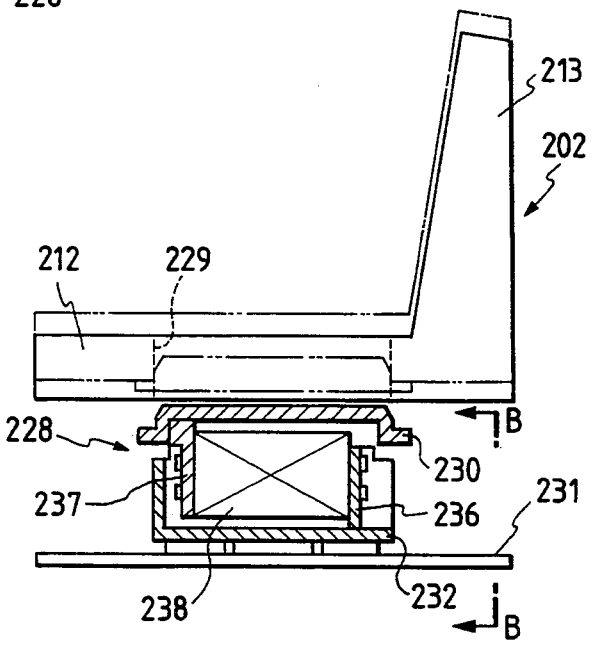

PACKAGE INSPECTION APPARATUS

BACKGROUND OF THE INVENTION

1. Field of the Invention

The present invention relates to an inspection apparatus for checking for the presence or absence of a bunch winding and buldge winding and for inspecting package weight of a package, specifically, a cheese-like package produced by a spun yarn winder and having a large diameter.

2. Prior Art

A cheese-like package is delivered after going through a spinning process, a finishing process and a packaging process in a raw yarn shop. The spinning process includes spinning out and winding, producing a large cheese-like package measuring 300 mm or more in diameter and weighing 12 kg or more by the use a spun yarn winder. This process requires a prolonged period of time for winding. Particularly, the finishing process includes various many items to be performed, requiring its automatization. For this purpose, a yarn end treating apparatus, a package inspection apparatus and a labeling apparatus have been developed as equipment for the finishing process. The yarn end treating apparatus automatically performs surface treatment and bunch winding of a package on a square tray. Especially the bunch winding will serve as a leader to be used when piecing yarn ends of packages to be unwound, and therefore is indispensable for this type of packages. The package inspection apparatus is preferably designed to automatically check the package for at least defective shape, check the presence or absence of the bunch winding, and to check the weight of the package.

As a package bunch winding inspection apparatus a bunch winding inspection apparatus for checking a conic package produced by an automatic winder has been known as is disclosed in Laid-Open Japanese Patent Application No. Sho 63-135532. This inspection apparatus checks for the presence or absence of a bunch winding by comparing with a model data an image photographed by a linear sensor by utilizing the reflection of the light projected from a light source to the bunch winding while the package is rotating. It is conceivable that this conic package bunch winding inspection apparatus can be used for checking cheese-like packages produced by a spun yarn winder.

There is, however, such a problem that the conic package bunch winding inspection apparatus is not usable because of a difference in shape between conic packages produced by the automatic winder and cheese-like packages produced by the spun yarn winder. First, the cheese-like package produced by the spun yarn winder is, practically, too heavy and too large to check while turning the package, and therefore must be checked for the presence or absence of the bunch winding without turning the package. Also, if the contact pressure has been improperly adjusted in the spun yarn winder for winding the cheese-like package, there takes place a bulged package that the package end face of the bobbin swells out in the axial direction. This bulge will disturb an optical inspection to be effected of a bunch winding wound on the bobbin. It will, therefore, become necessary to inspect packages while avoiding a bulged one.

In recent factories using spun yarn winders, a spinning process, finishing process, and palletizing process have been automatized in succession. The automatization of the finishing process will require no inspection engineers for visual inspections and other inspection items. From this the addition of a bulge winding inspection to automatic inspection items of the finishing process has come to be demanded.

OBJECT AND SUMMARY OF THE INVENTION

The present invention has been accomplished in an attempt to solve the problems mentioned above when the prior-art bunch winding detecting apparatus is applied to the inspection of cheese-like packages produced by the spun yarn winder. It is, therefore, an object of the present invention to provide a bunch winding inspection apparatus which is capable of fully checking a bunch winding of a cheese-like package produced by the spun yarn winder.

It is another object of the present invention to provide a bulge winding inspection apparatus which is capable of detecting a bulge winding in the continuous flow of automatic inspection items.

It is still another object of the present invention to provide a package inspection apparatus which allows easy inspection of bunch winding, bulge winding and package weight.

To attain the above-mentioned object, the bunch winding inspection apparatus of the present invention comprises a tray having a peg shaft horizontally protruding, a light source having an optical axis inclined 30 to 60 degrees to the package end face so as to illuminate the bunch winding wound on a bobbin of a cheese-like package inserted on a peg shaft, an area sensor having an optical axis inclined 5 to 15 degrees from the package end face so that an image of the bunch winding produced by the light from the light source is photographed, and a treating circuit which judges the presence or absence of a bunch winding from the brightness of the image thus photographed by the area sensor.

The light of the light source having an optical axis inclined 30 to 60 degrees to the package end face is projected to the bunch winding to produce its shadow, thus preventing an interference between the optical axis inclined 5 to 15 degrees to the package end face and the bulge winding when an image of this shadow is read by the area sensor.

To attain the another object stated above, the bulge winding inspection apparatus of the present invention comprises a tray with a horizontally protruding peg shaft having a large-diameter flange which is in contact with the end of a bobbin of a package, a light source for illuminating the large-diameter flange of a peg shaft and the end section of the package inserted on the peg shaft, an area sensor for reading the reflected light from the end section of the package and the large-diameter flange, a computing circuit for finding, from an image photographed by the area sensor, a distance of a dark area between the end section of the package and the large-diameter flange, and a comparing circuit for comparing the distance of this dark area with a specific value.

The distance between the package end and the large-diameter flange is determined by the contact of the package bobbin with the large-diameter flange of the peg shaft. The presence of a bulge winding decreases the distance. The package end and the large-diameter flange, when applied with the light, reflect the light, appearing as bright areas. The bobbin situated midway appears dark, and therefore the distance between the package end and the large-diameter flange is determined by the area sensor which photograph this area. The distance thus determined is compared with a specific value to know the presence or absence of a bulge winding.

BRIEF DESCRIPTION OF THE DRAWINGS

FIG. 10 is a view showing the construction of the interior of the inspection room;

FIG. 11 is an enlarged sectional view showing the construction of a weight measuring section;

DETAILED DESCRIPTION OF PREFERRED EMBODIMENT

Figure 1:
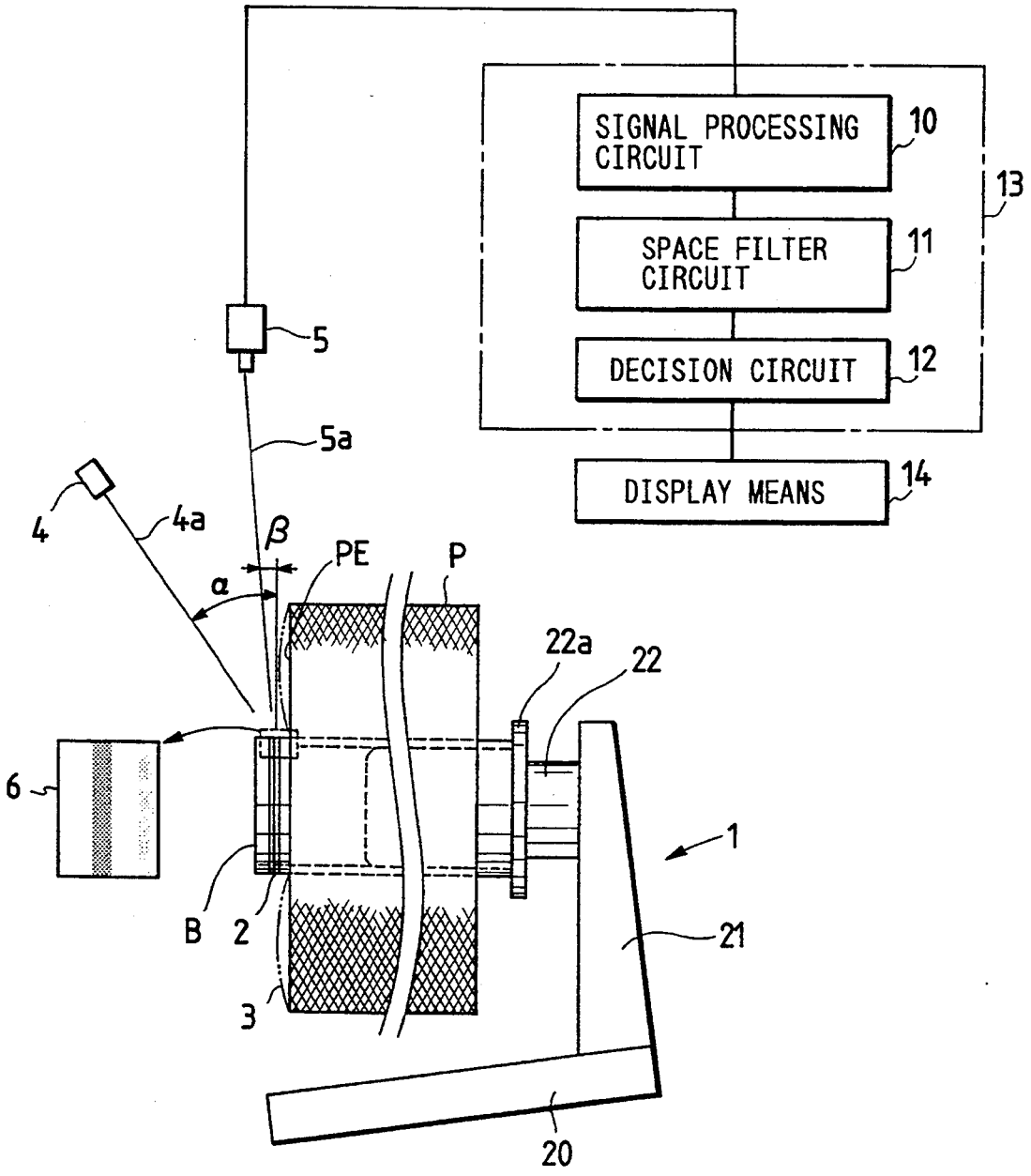
FIG. 1 is a view showing a major portion of a bunch winding inspection apparatus of the present invention.

Hereinafter an exemplary embodiment of a package bunch winding inspection apparatus according to the present invention will be explained by referring to the drawings. FIG. 1 is a view showing a major portion of the inspection apparatus of the present invention.

In FIG. 1, a numeral 1 denotes a square tray, which consists of a square table 20, a side wall 21, and a peg shaft 22. The peg shaft 22 is provided with a flange 22*a*, with which a cheese-like package P inserted on the peg shaft 22 is positioned properly in relation to the tray 1. A numeral 2 refers to a bunch winding on a bobbin of a cheese-like package P, and a numeral 3 is a bulge winding occurring on a package end face PE. A numeral 4 expresses a light source such as a halogen lamp, which illuminates the bunch winding 2 portion of the bobbin B. A numeral 5 represents an area sensor such as a CCD camera, which provides a photographed image of brightness and darkness of the bunch winding from a reflected light coming through the window 6 situated astride the end of the package P and the bobbin B. The use of the CCD camera as an area sensor provides a window 6 having the resolution of 512×512 bits capable of distinguishing bright and dark areas as flat positional information, obtaining a reflected-light image of brightness and darkness of the bunch winding 2. A shadow in this image of the bunch winding appears as a line in the area sensor 5, detecting a partial foreign substance and the bunch winding 2, which, therefore, will never be confused with each other. The focal length is set so that the focus of this area sensor 5 will be placed on the surface of the bobbin B. The bobbin B usually has a surface of solid color. A reference numeral 10 denotes a signal processing circuit for processing signals from the area sensor 5; a numeral 11 is a space filter circuit; a numeral 12 is a decision circuit; a numeral 13 is a processing circuit comprising these circuits; and a numeral 14 denotes a display means.

The optical axis 4*a* of the light source 4 is inclined by the angle $\alpha$ of 30 to 60 degrees to the end face of the package. It is necessary to incline the optical axis 4*a* to at least 30 degrees in order to produce a clear image of brightness and darkness of shadow of the bunch winding 2. If the inclination of the optical axis exceeds 60 degrees, the reflected light to the area sensor 5 will decrease. The optical axis 5*a* of the area sensor 5 is inclined by the angle $\beta$ of 5 to 15 degrees to the end face of the package, preferably around 10 degrees. The cheese-like package P on the spun yarn winder side will sometimes swell into a bulge winding 3, which, however, presents qualitatively no problem in particular and therefore is permissible if slight. In order to prevent this bulge winding 3 from obstructing the check of a normal bunch winding 2, the optical axis is desired to be set at the angle $\beta$ of 5 to 15 degrees notwithstanding it varies with the degree of allowance of the bulge winding 3. At this angle $\beta$ the normal bunch winding 2 will not be interfered with the bulge winding 3.

The window 6 having brightness and darkness as illustrated is photographed by the area sensor 5 and the light source 4, a photographed image being processed to a flat data by means of the signal processing circuit 10. The space filter circuit 11 filters off low-frequency components to smooth the data, thus removing noise. From this data thus filtered by the space filter circuit 11, the decision circuit 12 detects the presence of a line crossing the window 6, thus confirming the bunch winding 2. When no bunch winding 2 exists on the bobbin B, the display means will display it to warn to this effect.

Figure 2:
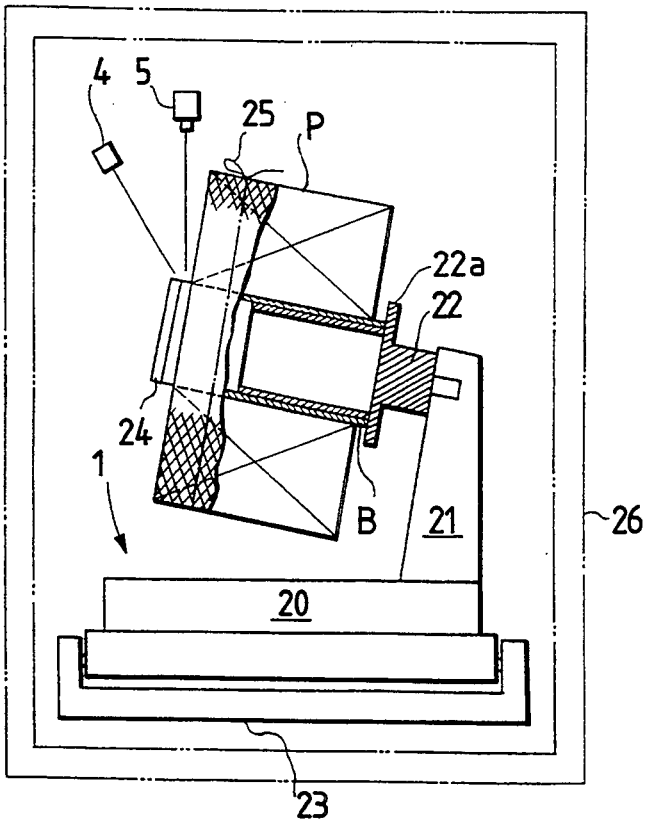
FIG. 2 is a side view of a tray.
Figure 3:
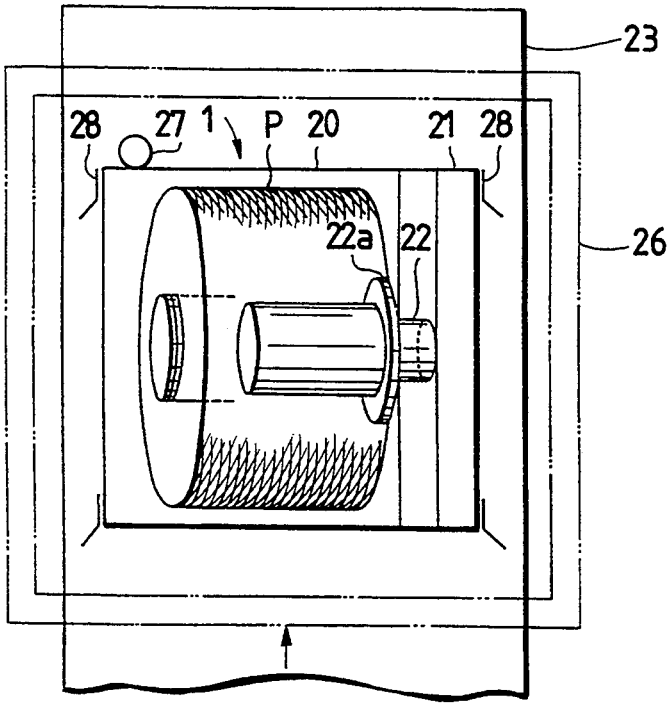
FIG. 3 is a top view of the tray.

Subsequently the tray which is a part of the bulge winding inspection apparatus will be explained in detail with reference to FIGS. 2 and 3. The package P is inserted over the peg shaft 22 of the tray 1. The bobbin B is in contact at its one end with the flange 22*a*. The peg shaft 22 protrudes horizontally, slightly inclined upward, so that the package P will not move off its position. This tray 1 mounted with a package P is carried on a conveyor 23. On this conveyor 23, bunch winding 24 and yarn end treatment 25 are performed. On the way of this conveyor 23 is installed a dark room 26, in which the light source 4 and the area sensor 5 are installed. In FIG. 3, a numeral 27 denotes a stopper which can move out and in; a numeral 28 is a positioning guide. Since the tray 1 for automatic inspection is utilized for bunch winding inspection, the inspection can be done most efficiently. In this dark room the bulge winding inspection apparatus using the light source and the area sensor may be incorporated.

According to the bunch winding inspection apparatus of the present invention, the optical axis of the light source is inclined 30 to 60 degrees to the end face of the package to form a shadow of the bunch winding. An image of this shadow is read by the area sensor. At this time, interference between the optical axis inclined 5 to 15 degrees to the end face of the package and a bulge winding can be prevented to detect the shape of the bunch winding as a flat information, thus enabling detection of a bunch winding on a specific heavy cheese-like package having a bulge winding, without turning the cheese-like package.

Figure 4:
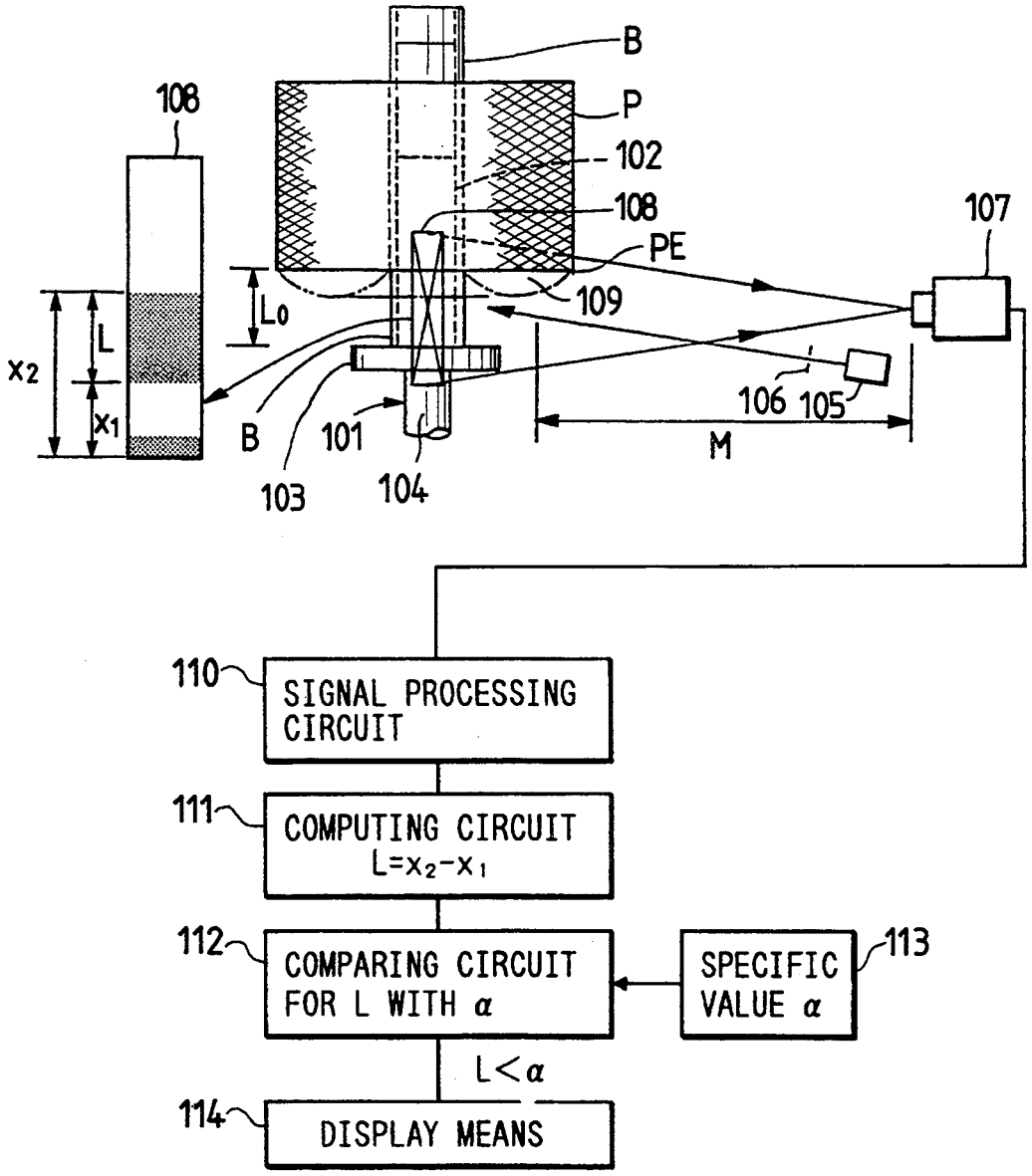
FIG. 4 shows a major portion of a bulge winding inspection apparatus of the present invention.

Hereinafter the embodiment of a bulge winding inspection apparatus according to the present invention will be explained with reference to the drawings. FIG. 4 is a drawing showing a major portion of the bulge winding inspection apparatus of the present invention.

In FIG. 4, a numeral 101 is a peg shaft of a tray, which consists of a cylindrical body 102 inserted in a bobbin B of a package P, a large-diameter flange 103 which contacts with the bobbin B, and a base section 104. A numeral 105 denotes a light source such as a halogen lamp, inclined about 10 degrees in relation to the axis of the area sensor 107. The light passing through a slit 106 illuminates the end section of the package P, the bobbin B and the large-diameter flange 103. A numeral 107 is the area sensor, which functions as a CCD camera, mounted nearly at right angles with the axis of the bobbin B, producing an image of the reflected light coming through a window 108 located astride the end section of the package P, bobbin B and large-diameter flange 103. With the CCD camera used the area sensor, the window 108 has a resolution of 512×512 bits, distinguishing bright and dark areas as flat positional information. The focal length M has been set so that the focus of the area sensor 107 is positioned at a mean value of the radii of the package P and large-diameter flange 103. A numeral 110 refers to a signal processing circuit which processes from the area sensor 107; a numeral 111 is a computing circuit for computing the length L of the dark area; a numeral 112 is a comparing circuit for comparing the length L of the dark area with a specific value $\alpha$; a numeral 113 presents a memory circuit for storing the specific value $\alpha$; and a numeral 114 denotes a display means.

The operation of the bulge winding inspection apparatus described above is as follows. When the package P is inserted on the peg shaft 101, the bobbin B contacts the large-diameter flange 103 as illustrated. If the package P is in normal condition, the length $L_0$ between the end section PE and the large-diameter flange 103 is determined as specified. However, if the package P is bulged as a bulge winding 109, the length between the end section PE and the large-diameter flange 103 decreases. When this area is illuminated by the light from the light source 105, the end section PE and the large-diameter flange 103 appear bright, while the bobbin B area appears dark. Then, this dark area is displayed on the window 108 of the area sensor 107, obtaining a signal of this dark area as a positional signal by the use of the signal processing signal 110. For example, when the direction of length of the window 108 is plotted on the axis x and the large-diameter flange 103 side at zero, the end of the large-diameter flange will become $x_1$ and the package end section PE will be $x_2$. Therefore it is possible to calculate out the length L between the end section PE and the large-diameter flange 103 as $L=x_2-x_1$ by the computing circuit 111. Subsequently, the comparing circuit 112 judges that the package is bulged when the length L decreases to less than the specific value $\alpha$ (e.g., $L_0\times0.9$ is to be inputted in the memory section 113), and the display means 114 warns the operator of the bulge winding.

Figure 5:
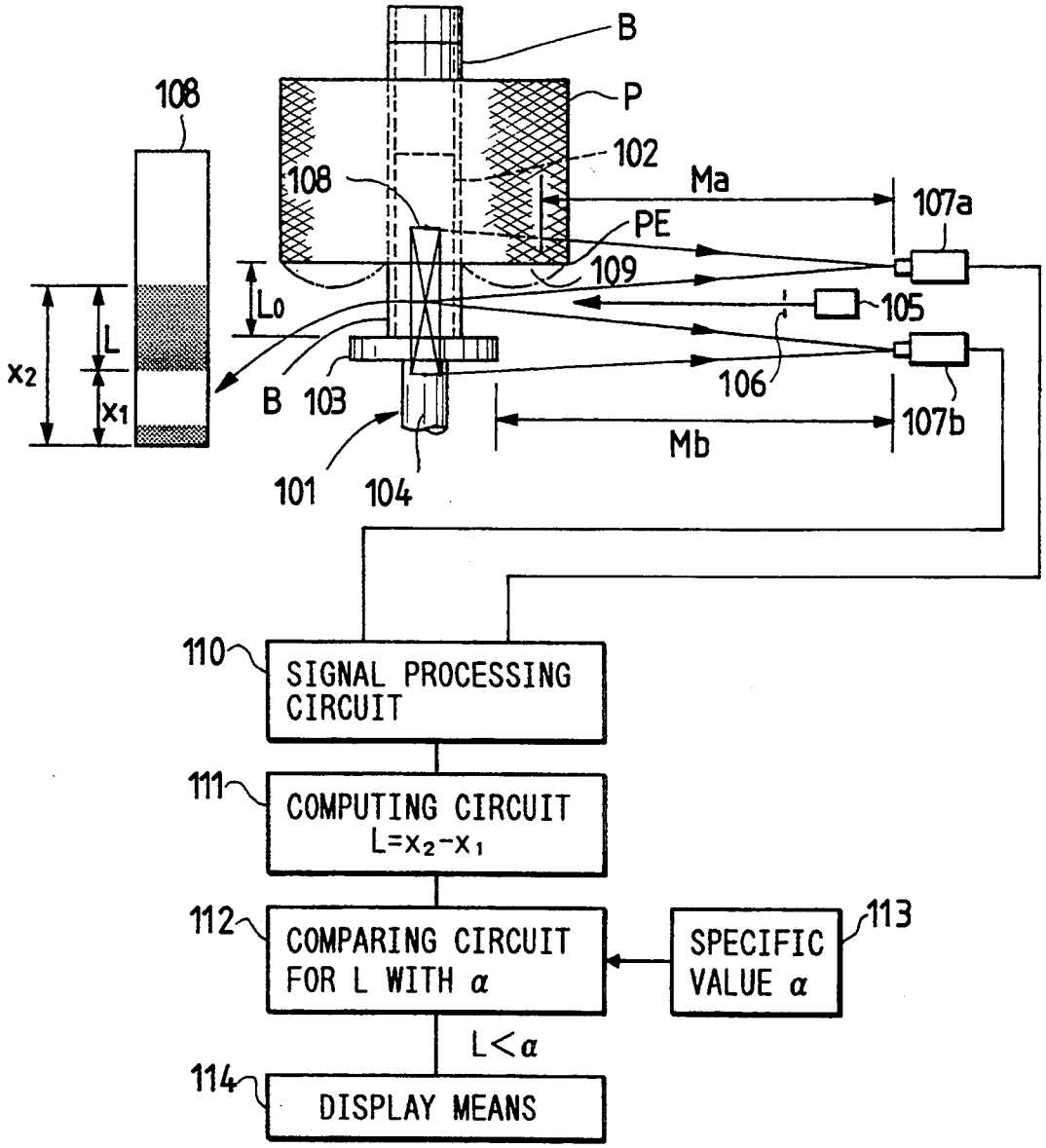
FIG. 5 shows a major portion of another buldge winding inspection apparatus of the present invention.

FIG. 5 shows a major portion of another inspection apparatus of the present invention. Its difference from FIG. 4 resides in the use of two area sensors 107*a* and 107*b* having different focal lengths. The package end face PE is photographed with the focus adjusted by the area sensor 107*a* for the focal length Ma, while the large-diameter flange 103 of the tray is photographed with the focus adjusted by the area sensor 107*b* for the focal length Mb, thereby obtaining accurate images respectively. In this case, both the area sensors 107*a* and 107*b* cooperate to form the window 108, synthesizing a single window 108 by the signal processing circuit 110.

Figure 6:
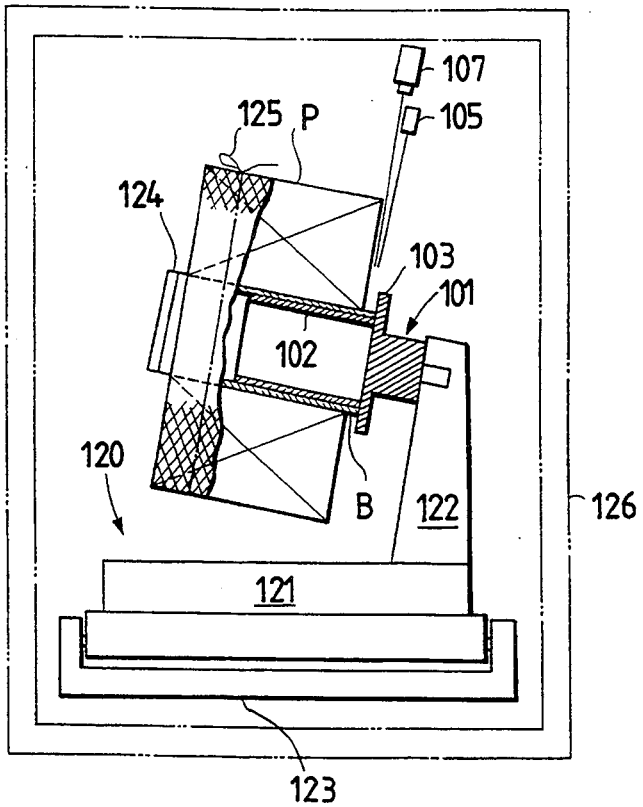
FIG. 6 is a side view of a tray.

Subsequently, the tray which is a part of the bulge winding inspection apparatus will be explained in detail by referring to FIG. 6. A tray 120 consists of a square base 121, a side wall 122, and a peg shaft 101. On the cylindrical body 102 of the peg shaft 101 is inserted the package P, and the end of the bobbin B is in contact with the large-diameter flange 103. The tray 120 with the package P inserted on the cylindrical body 102 is carried on a conveyor 123; on this conveyor the package P will undergo bunch winding 124 and yarn end treatment 125. On the way of this conveyor 123 is provided a dark room 126, in which the light source 105 and the area sensor 107 are installed.

The bulge winding inspection apparatus of the present invention functions to inspect a bulge winding with reference to a distance from the package end section and a large-diameter flange with a package bobbin held in contact with the large-diameter flange of a peg shaft. When the light is applied from the light source to the package end section and the large-diameter flange, the bobbin situated midway appears dark. Utilizing this effect, an area sensor photographing this area determines a distance from the package end to the large-diameter flange and compares the distance with a specific value, thus indicating the presence or absence of the bulge winding. Therefore the package inserted on the peg shaft of the tray automatically undergoes a continuous flow of inspections for the detection of the bulge winding.

A package inspection apparatus which allows easy inspection of bunch winding, bulge winding and package weight will be described hereinafter.

The package inspection apparatus of the present invention comprises a tray having an inclined peg for package insertion, a conveyor having a pair of chains for tray conveyance, an inspection box mounted on the conveyor, a light source and a camera mounted in the inspection box for checking a package for bunch winding and bulge winding, and a package weight measuring instrument vertically movably mounted between the chains.

Since the package inspection apparatus of the present invention is of such a construction that a package is mounted and conveyed in an inclined position on a tray, a bunch winding part and a bulge winding part are easily illuminated with the light from a light source and accordingly these parts can easily be photographed by a camera. Furthermore since a package weight measuring instrument is moved up and down between a pair of chains for conveying the package to thereby weigh the package, package weight inspection also can easily be performed.

Figure 7:
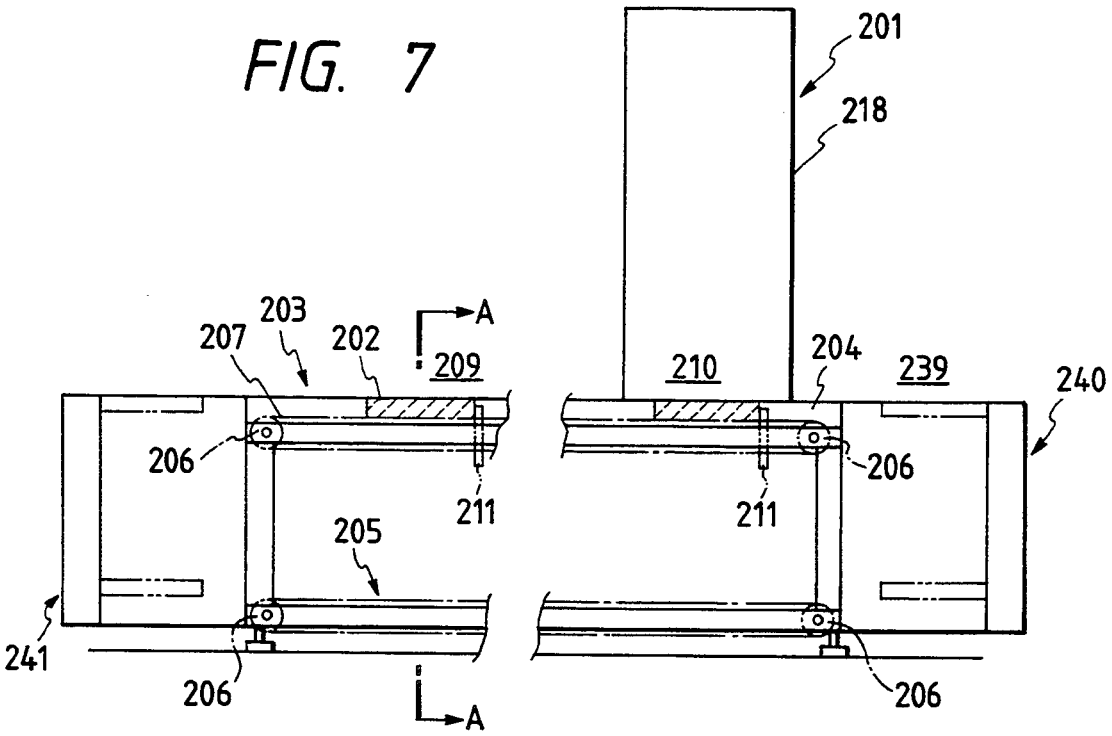
FIG. 7 is a side view showing one embodiment of a package inspection apparatus according to the present invention.
Figure 8:
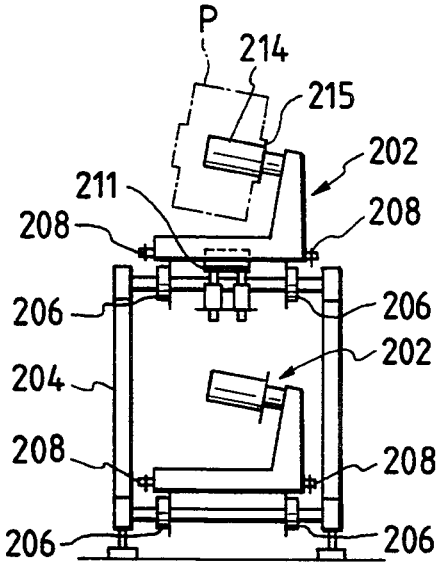
FIG. 8 is a schematic sectional view taken along line A—A of FIG. 7.

In FIGS. 7 and 8, a numeral 201 refers to an inspection apparatus for inspecting the appearance and weight of a package P produced from an automatic winder. This inspection apparatus 201 is equipped with a conveyor 203 for carrying the package P on the tray 202. This conveyor 203 is arranged on the upper stage of the frame 204. On the lower stage of the frame 204 is installed a return conveyor 205 for returning the tray 202. Both of the conveyors 203 and 205 have a pair of right and left sprockets 206 at the front and rear ends in the direction of conveyance, and an endless roller chain 207 is installed between the front and rear sprockets 206.

The tray 202 is mounted on the right and left chains, and more concretely on a roller (not illustrated), and is carried by driving the chains 207. On each of the conveyors 203 and 205, a number of guide rollers 208 are installed along the direction of conveyance for guiding both sides of the tray 202.

On the upstream of the conveyor 203 is installed a package feed station 209 for feeding the package P to an empty tray 202; and on the downstream of the conveyor 203 is installed in inspection station 210 for the inspection of the package P. Each of the stations 209 and 210 is provided with a tray stopper for stopping the tray 202.

The tray 202 has an arm 213 rising on one side of a square base plate 212, and a peg 214 for inserting the package P is installed obliquely upward on the inner wall of the arm 213. This peg 214 is provided with a stopper 215 to stop the insertion end of the package P.

Figure 9:
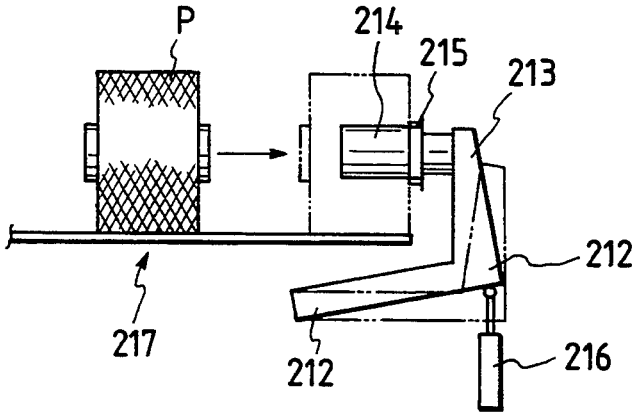
FIG. 9 is a view showing the construction of a package feed section.
Figure 12:
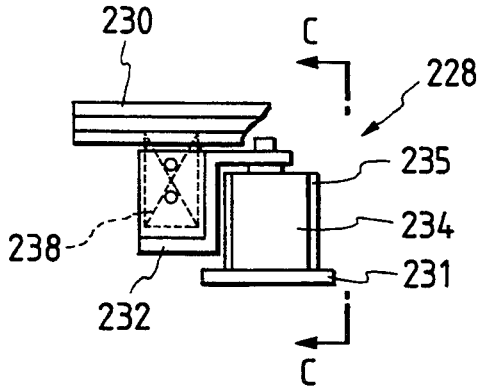
FIG. 12 is a view taken along line B—B of FIG. 5.
Figure 13:
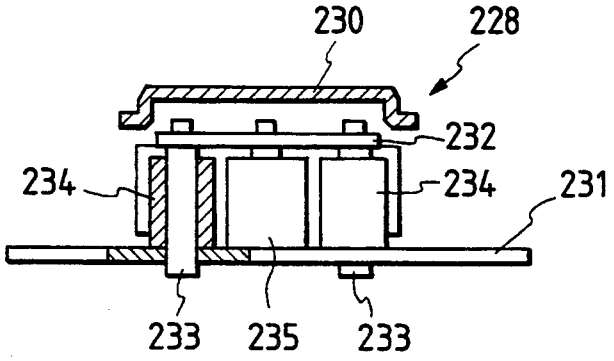
FIG. 13 is a sectional view taken along line C—C of FIG. 12.

In the package feed station 209 are installed a lifter 216 which pushes up the bottom of the arm 213 side of the tray 202 to set the peg 214 in the level position as shown in FIG. 9, and a package feed apparatus 217 which carries the package P horizontally and inserts it on the peg 214.

In the inspection station, on the other hand, an inspection box 218 is mounted as a dark room for holding the package P for appearance inspection. In the front and rear walls of this inspection box 218 are provided openings 219 through which the tray 202 carrying the package P can pass as shown in FIG. 10. The opening 219 is provided with a shutter 221 which is driven to open and close by a fluid-pressure cylinder 220.

In the inspection box 218 are mounted light sources 222 and 223 and cameras 224 and 225 for checking a bunch winding and a bulge winding on the package P. In this case, in order to facilitate the inspection, a check is made for a bulge winding (swelling) on the insertion end side of the package and then a check for a bunch winding 226 positioned on the opposite side of the insertion end. The light source 222, 223 applies spot light at a specific angle of projection from outside to both end sections of a core tube 227 of the package P, and the cameras 224 and 225 photographs the area illuminated by the spot light. Concretely, the bunch winding photographing camera 224 is mounted slightly inclined outside so that the field of view will not be narrowed with the bulged end of the yarn layer, and the presence or absence of the bunch winding 226 is judged from the shadow of the yarn wound on the core tube 227. The camera 225 for photographing a bulge winding is so mounted as to photograph the surface of the core tube 227; the presence or absence of the bulge winding is judged on the basis of the size of a shadow of the surface of the core tube 227 by the swell of the yarn layer end face.

Between the right and left chains 207 in the inspection station is vertically movably installed a package P weight measuring instrument 228. This weight measuring instrument 228 has a tray receiver 230 which is situated from below in the square opening 229 formed at the center of the base plate 212 of the tray 202, and a base plate 231 supporting the tray receiver 230 from the conveyor frame 204 side. On the base plate 231, a lift frame 232 is vertically movably supported through two sets of guide rods 233 and guides 234, and a fluid-pressure cylinder 235 is mounted upright for moving this lift frame 232 upward and downward. This lift frame 232 and the tray receiver 230 are provided with brackets 236 and 237 in opposite sides in the horizontal direction. Between these brackets 236 and 237 is interposed a load cell 238 as a weight sensor.

A package removing station 239 for removing the package P, after inspections, from the peg 214 of the tray 202 is located at the discharge end of the conveyor 203. The package P removed from the tray 202 is classified to an acceptable or a rejectable package P on the basis of inspection result. At the discharge end of the conveyor 203 is mounted a transfer apparatus 240 for transferring an empty tray 202 onto the return conveyor 205. Furthermore at the entrance end of the conveyor 203 is mounted a transfer apparatus 241 for transferring the empty tray 202 from the return conveyor 205 over to the conveyor 203.

Next, the operation of the embodiment of the package inspection apparatus stated above will be explained. First, when the empty tray 202 is stopped by the tray stopper at the package feed station 209 on the conveyor 203, the lifter 216 operates to tilt the tray 202 until the peg 214 comes to the level position. With the peg 214 inclined to the level position, the package P can easily be fed horizontally from the package feed apparatus 217 and inserted onto the peg 214. After the insertion of the package P, the lifter 216 and the tray stopper 211 go downward, and the tray 202 returns to the original position, then being conveyed to the inspection station 210. At the time of conveyance, the peg 214 is in an obliquely upward position and therefore the package P will never more along, or off from, the peg 214.

In the meantime, the shutter 221 of the opening 219 in the inspection box 218 is open and the tray 202 carrying the package P comes to the inspection station 210 until it is stopped with the tray stopper 211. When the tray 202 is thus stopped, the shutter 221 is closed, turning the light sources 222 and 223 on and at the same time the cameras 224 and 225 start photographing. Concretely, image signals from the cameras 224 and 225 are processed by a computer, which judges the presence or absence of a bunch winding and a bulge winding from the shadow of the image thus processed. Since the package P is mounted in an inclined state on the tray 202, the light from the light sources 222 and 223 can be applied with ease to the bunch or bulge winding areas and accordingly it is possible to photograph these areas easily with the cameras 224 and 225.

Subsequently, the cylinder 235 of the weight measuring instrument 228 operates to raise the tray receiver 230 from between the right and left chains 207 through the lift frame 232 and the load cell 238. The tray receiver 230 is then engaged with the opening 229 of the tray 202, raising the tray 202. Thus the load of the package P and the tray 202 is applied to the load cell 238. Concretely, the computer, an electric signal from the load cell 238, operates the weight of the package P, judging whether or not the weight is of a specified value. Since the package weight is measured with the weight measuring instrument 228 moved upward and downward between a pair of chains 207 for carrying the package P, the package weight can easily be checked.

After the completion of appearance and weight inspections of the package P, the tray stopper 211 moves downward and at the same time the shutter 221 opens to allow the tray 202 to move out of the inspection box 218. The tray 202 moves as far as the package removing station 239, where the package P is removed from the peg 214 of the tray 202. The tray 202 thus removed of the package P is then transferred by a transfer apparatus 240 over to the return conveyor 205 and furthermore transferred, for a reuse purpose, by the transfer apparatus 241 from the return conveyor 205 over to the conveyor 203.

According to the present invention, the package is conveyed in an inclined state on the tray, and the package weight measuring instrument is moved upward and downward between a pair of chains for carrying the package, to check the weight of the package, and consequently it is possible to easily perform the inspections of bunch winding, bulge winding and package weight.

We claim:

1. A package bulge winding inspection apparatus for inspecting a package, the apparatus comprising:

a tray including a peg shaft having a bobbin supporting member disposed for contacting an end of a bobbin of a package, a light source for illuminating the bobbin supporting member and an end of the package inserted on the peg shaft, an area sensor for capturing an image of the end of the package and the bobbin supporting member exposed to light from the light source, the image including at least a first area and a second area between the end of the package and the bobbin supporting member, the first area being relatively darker than the second area, a computing circuit for determining a length of the first, relatively darker area between the end of the package and the bobbin support member based upon the image captured by the area sensor, and a comparing circuit for comparing the length determined by the computing circuit with a predetermined value.

2. The apparatus of claim 1, wherein the peg shaft of the tray is oriented substantially horizontally and the bobbin support member comprises a flange secured on the peg shaft.

3. The apparatus of claim 2, wherein the bobbin defines a bobbin axis, the area sensor is mounted substantially at right angles to the bobbin axis, the area sensor defines an optical axis, the light source defines an optical axis, and the optical axis of the light source is inclined relative to the optical axis of the area sensor by approximately 10 degrees.

4. The apparatus of claim 2, wherein the area sensor comprises a first sensor and a second sensor, the first sensor being spaced from the package and having a focal length corresponding to the distance between the first sensor and the package, the second sensor being spaced from the flange and having a focal length corresponding to the distance between the second sensor and the flange.

5. A package inspection apparatus for inspecting a package having an end face and a bulge winding, the apparatus comprising:

a tray having a peg for mounting a package thereon, a conveyor having a pair of means for carrying the tray, an inspection box mounted on the conveyor, inspection means mounted in the inspection box for inspecting the package for bunch winding and bulge winding, and a vertically movable package weight measuring instrument mounted between the pair of means for carrying the tray, wherein the peg of the tray is provided with a flange disposed to contact an end of a bobbin of the package, and the inspection means includes a package bulge winding inspection apparatus comprising:

a light source for illuminating the flange and an end of the package inserted on the peg, an area sensor for capturing an image of the end of the package and the flange exposed to light from the light source, the image including a dark area between the end of the package and the flange, a computing circuit for determining a length of the dark area between the end of the package and the flange based upon the image captured by the area sensor, and a comparing circuit for comparing the length determined by the computing circuit with a predetermined value.

* * * * *